US010906200B2

(12) United States Patent
Yamaguchi et al.

(10) Patent No.: US 10,906,200 B2
(45) Date of Patent: Feb. 2, 2021

(54) DEVICE FOR PERFORATING PANELS OF MATERIAL

(71) Applicant: ASTON MARTIN LAGONDA LIMITED, Warwick (GB)

(72) Inventors: Takashi Yamaguchi, Aichi (JP); Bal Choda, Warwick (GB)

(73) Assignee: ASTON MARTIN LAGONDA LIMITED

( * ) Notice: Subject to any disclaimer, the term of this patent is extended or adjusted under 35 U.S.C. 154(b) by 76 days.

(21) Appl. No.: 16/307,114

(22) PCT Filed: Jun. 9, 2017

(86) PCT No.: PCT/GB2017/051695

§ 371 (c)(1),
(2) Date: Dec. 4, 2018

(87) PCT Pub. No.: WO2017/212293

PCT Pub. Date: Dec. 14, 2017

(65) Prior Publication Data

US 2019/0224878 A1 Jul. 25, 2019

(30) Foreign Application Priority Data

Jun. 9, 2016 (GB) ..... 1610107.3

(51) Int. Cl.
*B26D 7/20* (2006.01)
*B26F 1/16* (2006.01)
(Continued)

(52) U.S. Cl.
CPC ..... *B26F 1/16* (2013.01); *B26D 7/1863* (2013.01); *B26D 7/20* (2013.01); *B26F 1/02* (2013.01)

(58) Field of Classification Search
CPC . B26F 1/16; B26F 1/02; B26D 7/1863; B26D 7/20; B26D 7/01; B26D 7/02;
(Continued)

(56) References Cited

U.S. PATENT DOCUMENTS 2,405,598 A * 8/1946 Miller ..... B26D 7/20 83/556
3,730,634 A * 5/1973 Gerber ..... B26F 1/16 408/22
(Continued)

FOREIGN PATENT DOCUMENTS

CN 103068756 A 4/2013
DE 3037255 A1 4/1982
(Continued)

OTHER PUBLICATIONS

International Search Report and Written Opinion for PCT/GB2017/051695, dated Jan. 3, 2018, 18 pages.
GB Search Report for GB1610107.3, dated Feb. 22, 2017, 10 pages.

*Primary Examiner* — Andrea L Wellington
*Assistant Examiner* — Liang Dong
(74) *Attorney, Agent, or Firm* — Dorsey & Whitney LLP

(57) ABSTRACT

An apparatus for perforating a panel of material comprising a driver assembly; a perforation assembly comprising a cutting edge for cutting the panel of material; an impacting surface moveable with respect to the cutting edge; and, means for holding the panel of material in a material plane between the cutting edge and the impacting surface, wherein the driver assembly is arranged to drive the cutting edge through the material plane into the impacting surface to cut the panel of material.

13 Claims, 9 Drawing Sheets

(51) Int. Cl.
*B26F 1/02* (2006.01)
*B26D 7/18* (2006.01)

(58) Field of Classification Search
CPC .... B26D 3/085; B26D 5/00; B26D 2007/202; G01N 3/28
USPC ..... 83/589, 939–941, 466, 468.7, 435.7, 83/435.11, 346
See application file for complete search history.

(56) References Cited

U.S. PATENT DOCUMENTS

| | | | | |
|---|---|---|---|---|
| 4,437,373 | A * | 3/1984 | Van Der Meulen ... | B26D 1/105 83/346 |
| 4,471,677 | A | 9/1984 | Lissot et al. | |
| 6,223,637 | B1 | 5/2001 | Hansen | |
| 2002/0088321 | A1 | 7/2002 | Boscolo | |
| 2004/0182213 | A1 * | 9/2004 | Wagner ..... | B26D 7/20 83/343 |
| 2006/0011026 | A1 | 1/2006 | Dickey | |
| 2009/0000441 | A1 | 1/2009 | Hasebe et al. | |

FOREIGN PATENT DOCUMENTS

| | | | | |
|---|---|---|---|---|
| DE | 3325906 | A1 | 1/1985 | |
| DE | 3614106 | A1 * | 10/1987 | ..... B26D 7/20 |
| DE | 4417110 | A1 | 11/1995 | |
| DE | 19541129 | C1 * | 2/1997 | ..... B29C 66/43 |
| EP | 0502237 | A1 | 9/1992 | |
| EP | 0900637 | A2 | 3/1999 | |
| EP | 1541747 | A1 | 6/2005 | |
| GB | 955388 | A | 4/1964 | |
| GB | 1085723 | A * | 10/1967 | ..... B26D 3/065 |
| WO | 03095163 | A1 | 11/2003 | |
| WO | 2006108111 | A2 | 10/2006 | |

* cited by examiner

DEVICE FOR PERFORATING PANELS OF MATERIAL

CROSS-REFERENCE TO RELATED APPLICATIONS

This application is the national stage application of International Patent Application No. PCT/GB2017/051695, filed on Jun. 9, 2017, and entitled "A DEVICE FOR PERFORATING PANELS OF MATERIAL", which claims priority to GB Patent Application No. 1610107.3, filed on Jun. 9, 2016, and entitled "A DEVICE FOR PERFORATING PANELS OF MATERIAL", both of which are hereby incorporated by reference herein in their entireties for all purposes.

This invention relates to an apparatus and method of forming perforated and quilted panels. In particular, the invention relates to an apparatus and method of forming perforated and quilted panels for use in the interiors of automotive vehicles.

BACKGROUND

Quilted panels have been used to enhance the luxury appeal of the interiors of automotive vehicles for many years. The design of the quilting can be altered according to the contour stitching used, and the appearance of the panel can be further enhanced by the inclusion of a series of small holes, or perforations, arranged in a stylised fashion between the stitching. The manufacture of such panels is generally a two-stage process. Firstly, an automated sewing or quilting machine is used to apply stitch lines to a panel of material. Secondly, the quilted panel is then moved to a press tool, comprising a male punch and a female die, in order to create an arrangement of holes within and around the stitch lines. There are, however, a number of drawbacks with this two-stage process. For example, misalignment of the panel with respect to the quilting machine and/or the press tool is possible, which can ruin the panel. This is particularly an issue when the panel has already been quilted and is then moved to the press tool. Moreover, any modification to the arrangement of perforations would require new male punch and female die components, which add expense and complexity to the overall process.

The present invention seeks to overcome or substantially mitigate at least the foregoing problems.

STATEMENTS OF INVENTION

According to a first aspect of the invention, there is provided an apparatus for perforating a panel of material comprising a driver assembly, a perforation assembly comprising a cutting edge for cutting the panel of material, an impacting surface and means for holding the panel of material in a material plane between the cutting edge and the impacting surface, wherein the driver assembly is arranged to drive or force the cutting edge through the material plane into the impacting surface to cut the panel of material, the apparatus being characterised in that the impacting surface is moveable with respect to the cutting edge. The fact that the impacting surface is moveable means that the cutting edge is not repeatedly driven into the same point on the impacting surface during use, which prolongs the use of the impacting surface.

Preferably, the impacting surface is rotatable.

Preferably, the impacting surface is a spherical surface.

Preferably, the impacting surface is the surface of a ball rotatable about a fixed point in space. The ball can be held in a housing and is arranged to sit on a plurality of ball bearings located at the bottom of the housing. Preferably, the interior of the ball is solid and the ball is made substantially of polypropylene with a density between 0.895 and 0.92 $g/cm^3$ and a Young's modulus between 1300 and 1800 $N/mm^2$.

Preferably, the apparatus further comprising a positioning means for moving the panel of material in the material plane with respect to the cutting edge. Wherein the material plane is positioned so that the underside of the panel of material held by the holding means contacts the impacting surface providing a frictional connection therebetween, and wherein the impacting surface is moveable as the panel of material is moved in the material plane by the positioning means. This arrangement reduces the complexity of the apparatus by eliminating the need for a separate means of moving the impacting surface.

Preferably, the positioning means comprises a pantograph.

Preferably, the impacting surface is resiliently deformable. That is to say, the impacting surface has a tendency to recover its original form after having been struck by the cutting edge. The fact that the impacting surface is deformable means that the cutting edge is not substantially damaged when driven into the impacting surface. Moreover, the fact that the impacting surface is resiliently deformable means that can be reused before it eventually needs replacing.

Preferably, the driver assembly is arranged to drive the cutting edge into the impacting surface against a biasing means.

According to a second aspect of the invention, there is provided a method of perforating a panel of material comprising the steps of holding the panel of material in a material plane between a cutting edge and an impacting surface; driving or pushing the cutting edge through the material plane into the impacting surface to cut the panel of material; and, moving the impacting surface with respect to the cutting edge.

Preferably, the impacting surface is moved by being rotated.

Preferably, the impacting surface is rotated about a fixed point.

Preferably, the method further comprises the steps of positioning the material plane so that the underside of the panel of material contacts the impacting surface to provide a frictional connection therebetween and moving the panel of material in the material plane to move the impacting surface.

According to a third aspect of the invention, there is provided an apparatus for perforating a panel of material comprising a driver assembly, a perforation assembly comprising a cutting edge for cutting the panel of material and means for holding the panel of material in a material plane, wherein the driver assembly is arranged to drive the cutting edge from an uppermost position through the material plane to a lowermost position to cut the panel of material, the apparatus being characterised in that the perforation assembly further comprises means for rotating the cutting edge during movement from the uppermost position to the lowermost position. The fact that the cutting edge is arranged to rotate means that it cuts into the panel of material as opposed to the shearing action seen in conventional press tools comprising a male punch and a female die, which tends to tear or rip the material. This improves the finish of the perforations, which increases the quality the panel of material and can also increase its useful life.

Preferably, the perforation assembly further comprises a hollow first shaft secured to the driver assembly and a second shaft on which the cutting edge is fixedly mounted, the second shaft being concentrically mounted within the first shaft and configured for axial movement with respect to the first shaft when the cutting edge is driven from the uppermost position to the lowermost position, wherein the rotating means is arranged to rotate the cutting edge during the respective axial movement between the first and second shafts. That is, the cutting edge is required to rotate at some point during its movement from the uppermost position to the lowermost position. The respective axial movement moves the shafts from an expanded configuration to a compressed configuration when the cutting edge is driven from the uppermost position to the lowermost position respectively.

Preferably, the rotating means comprises a roller rotatably secured to the second shaft and an open track coiling around the first shaft, wherein the roller is configured for movement along the open track from a lowermost point to an uppermost point during the respective axial movement between the first and second shafts. This provides a straightforward arrangement of translating the respective axial movement into a rotational movement, in which only the roller needs replacing occasionally. Preferably, the roller is made of a synthetic resin. The fact that the roller is made of a synthetic resin means that it is less likely to damage the first shaft as it moves along the open track.

Preferably, the second shaft is configured to move axially with respect to the first shaft by means of a force applied to the cutting edge from the panel of material during movement of the cutting edge from the uppermost position to the lowermost position.

Preferably, the second shaft is configured to move axially with respect to the first shaft against a biasing means. Moreover, the driver assembly is also arranged to drive the cutting edge from the uppermost position to the lowermost position against a biasing means.

Preferably, the cutting edge is arranged to rotate at least by 30 degrees. More preferably, the cutting edge is arranged to rotate by 40 degrees. This arrangement ensures that the cutting edge rotates all of the way through the panel of material. That is to say, the cutting edge cuts all of the way through the panel of material. The extent to which the cutting edge rotates can be varied according to the thickness of the panel of material.

Preferably, the means for holding the panel of material in the material plane is moveable.

According to a fourth aspect of the invention, there is provided a method for perforating a panel of material comprising the steps of holding a panel of material in a material plane; driving a cutting edge from an uppermost position through the material plane to a lowermost position to cut the panel of material; and, rotating the cutting edge during movement from the uppermost position to the lowermost position.

Preferably, the cutting edge is rotated by at least 30 degrees.

According to a fifth aspect of the invention, there is provided an apparatus for perforating a panel of material comprising a driver assembly, a perforation assembly comprising a cutting edge for cutting a slug of material from the panel of material and means for holding the panel of material in a material plane, wherein the driver assembly is arranged to drive the cutting edge from an uppermost position through the material plane to a lowermost position to cut the slug of material from the panel of material, the apparatus being characterised in that the perforation assembly further comprises a channel extending from the cutting edge, the channel being arranged to receive the slug of material as the cutting edge is driven through the material plane to cut the slug of material from the panel of material, and a suction means in fluidic communication with the channel, the suction means being arranged to create low pressure within the channel for removing the slug of material from the channel. Low pressure, in this instance, refers to a static pressure that is lower than the atmospheric pressure.

Preferably, the perforation assembly further comprises means for rotating the cutting edge during movement from the uppermost position to the lowermost position. Preferably, the means for holding the panel of material in the material plane is moveable.

Preferably, the perforation assembly further comprises a first shaft secured to the driver assembly and a second shaft on which the cutting edge is fixedly mounted, the second shaft being concentrically mounted within the first shaft and configured for axial movement with respect to the first shaft when the cutting edge is driven from the uppermost position to the lowermost position, wherein the rotating means is arranged to rotate the cutting edge during the respective axial movement between the first and second shafts.

Preferably, the rotating means comprises a roller rotatably secured to the second shaft and an open track coiling around the first shaft, wherein the roller is configured for movement along the open track from a lowermost point to an uppermost point during the respective axial movement between the first and second shafts.

Preferably, the second shaft is configured to move axially with respect to the first shaft by means of a force applied to the cutting edge from the panel of material during movement of the cutting edge from the uppermost position to the lowermost position.

Preferably, the second shaft is configured to move axially with respect to the first shaft against a biasing means. Moreover, the driver assembly is also arranged to drive the cutting edge from the uppermost position to the lowermost position against a biasing means.

Preferably, the suction means is connected to the channel by a flexible tube, which is connected to the channel by a quick-fix connector.

According to a sixth aspect of the invention, there is provided a method for perforating a panel of material comprising the steps of holding a panel of material in a material plane;

driving a cutting edge from an uppermost position through the material plane to a lowermost position to cut a slug of material from the panel of material; receiving the slug of material in a channel connected to the cutting edge as the cutting edge is driven through the material plane to cut the slug of material from the panel of material; and, creating a low pressure, relative to the atmospheric pressure, within the channel for removing the slug of material from the channel.

Preferably, the method further comprising the step of rotating the cutting edge during its movement from the uppermost position to the lowermost position.

According to a seventh aspect of the invention, there is provided a quilting and perforating machine comprising an apparatus according to the first, third or fifth aspects of the present invention.

DRAWINGS

The above and other aspects of the invention will now be described, by way of example, with reference to the accompanying drawings, in which.

In the drawings, like parts are denoted by like reference numerals.

SPECIFIC DESCRIPTION

Figure 1:
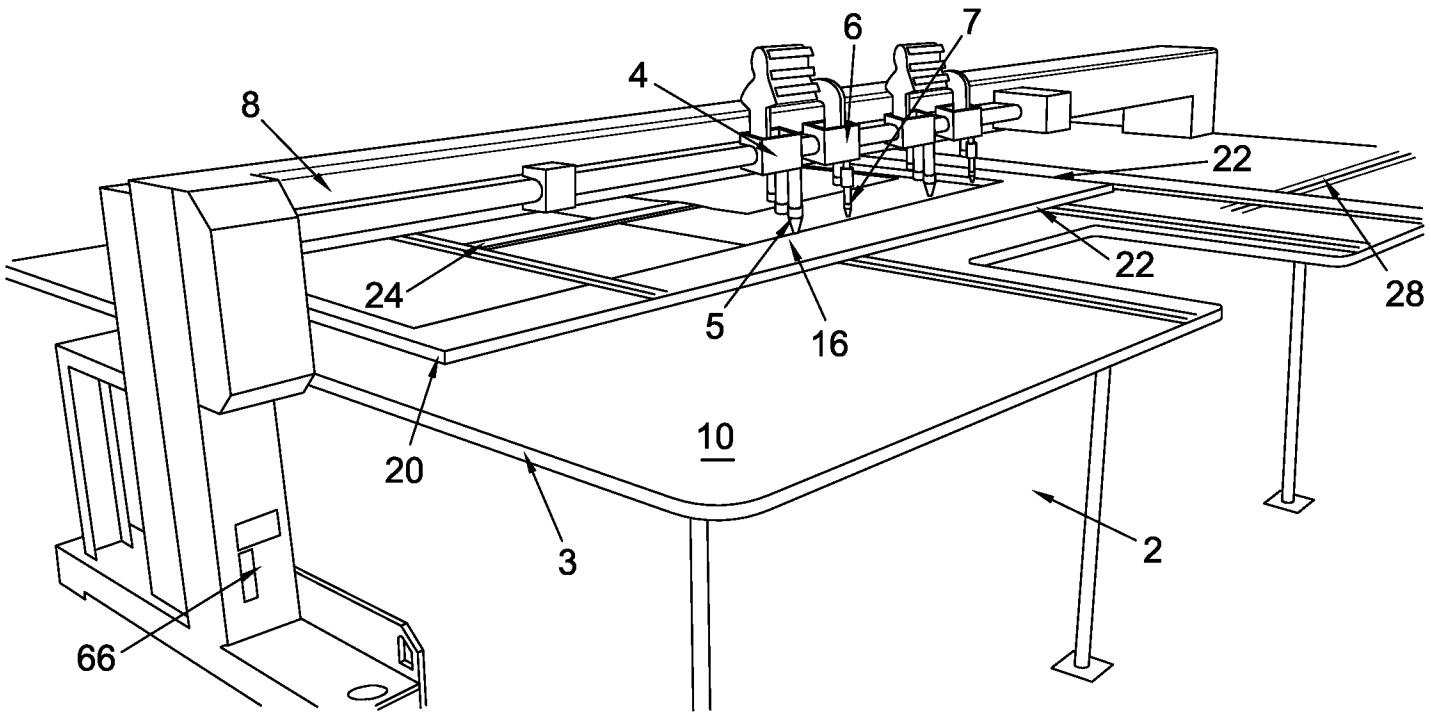
FIG. 1 is a front perspective view of a quilting and perforating machine in accordance with the present invention.
Figure 2:
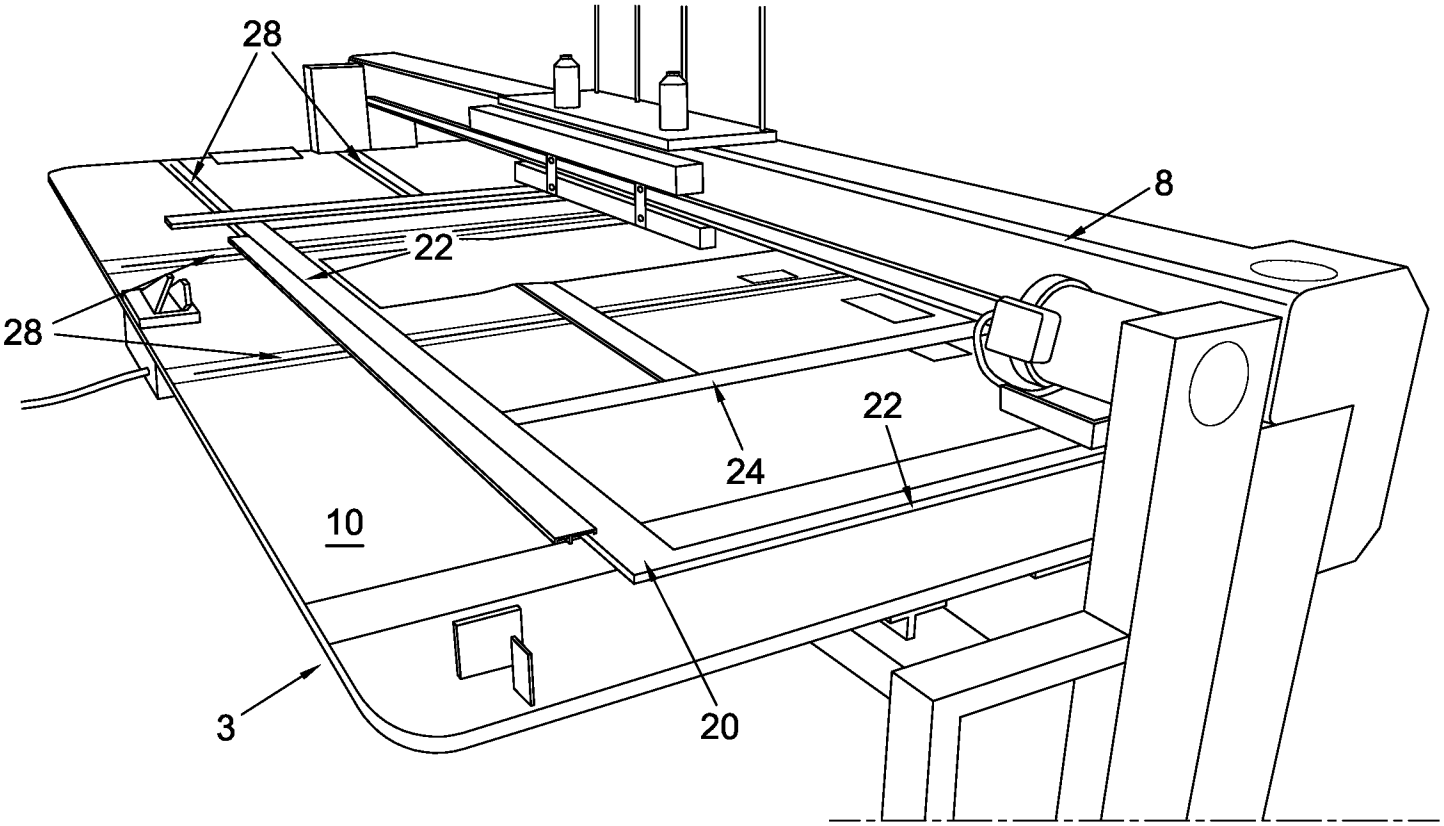
FIG. 2 is a rear perspective view of the machine of FIG. 1.

FIG. 1 and FIG. 2 show a quilting and perforating machine, generally designated by 2, comprising a quilting device 4 and a perforating device 6 (shown without their respective housings). The quilting device 4 and the perforating device 6 comprise a stitching head 5 and a perforating head 7 respectively, and are fixedly mounted to respective brackets 9. The stitching head 5 is a conventional stitching head comprising a plurality of positions for accommodating different needles, each of which may use a different coloured thread for sewing. The machine 2 further comprises a transverse beam 8, which functions to hold the brackets 9 in a fixed location above a substantially level upper surface 10 of a table 3. The surface 10 comprises two apertures 12, 14, one 12 of which is located directly beneath the stitching head 5 whilst the other 14 is located directly beneath the perforating head 7. Both apertures 12, 14 are partly covered by a needle plate 16 comprising a small opening 18. A moveable pantograph 20 is located above the surface 10 and comprises several components 22 fixed relative to each other in a generally rectangular configuration, together with at least one inner frame 24. The inner frame 24 functions to hold separate panels of material within the pantograph 20 to be quilted and perforated. The surface 10 further comprises five tracks 28, three of which extend laterally for approximately a third of the length of the surface 10, with the remaining two tracks 28 extending across the surface 10 perpendicular to the lateral tracks. Two motors (not shown) control movement of the pantograph 20 along the tracks 28 in a horizontal plane above the surface 10 so as to position a panel of material held in the pantograph 20 with respect to the stitching and perforating heads 5, 7. Control of the quilting device 4, the perforating device 6 and the two motors controlling the pantograph 20 is automated by the use of computer numerical control. This allows any number of designs to be applied to the panel of material using the same quilting device 4 and perforating device 6. In particular, it avoids the need for different male punch and female die components for different arrangements of perforations.

Figure 3:
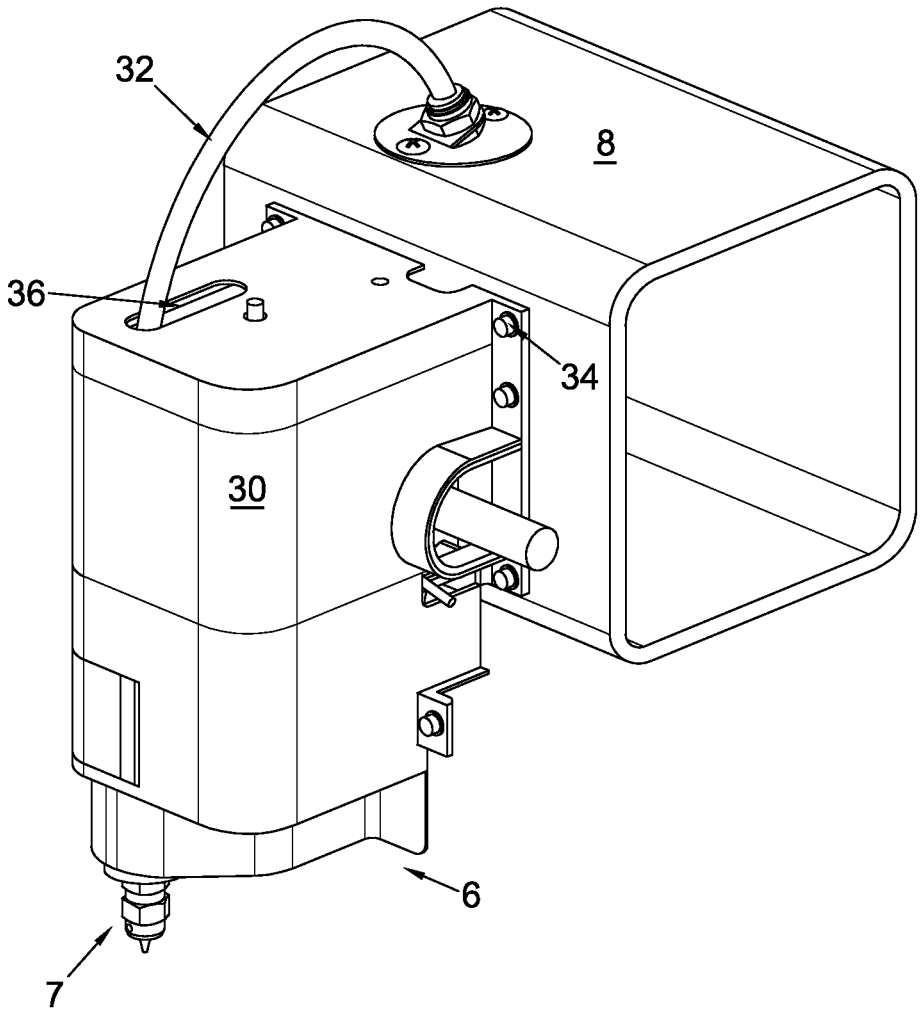
FIG. 3 is a perspective view of a perforating device for use with the machine of FIG. 1.

FIG. 3 shows the perforating device 6 comprising the perforating head 7 and a housing 30, together with a suction tube 32 extending through a hole 36 in the housing 30 to the transverse beam 8. The housing 30 is fixed to the beam 8 using a plurality of bolts 34 so as to provide easy access to the interior of the perforating device 6. The housing 30 can be removed to gain access to the interior of the perforating device 6 firstly by releasing the bolts 34 and disconnecting the suction tube 32 from the beam 8. The housing 30 can then be lifted up, allowing the suction tube 32 to pass through the hole 36, and away from the beam 8.

Figure 4:
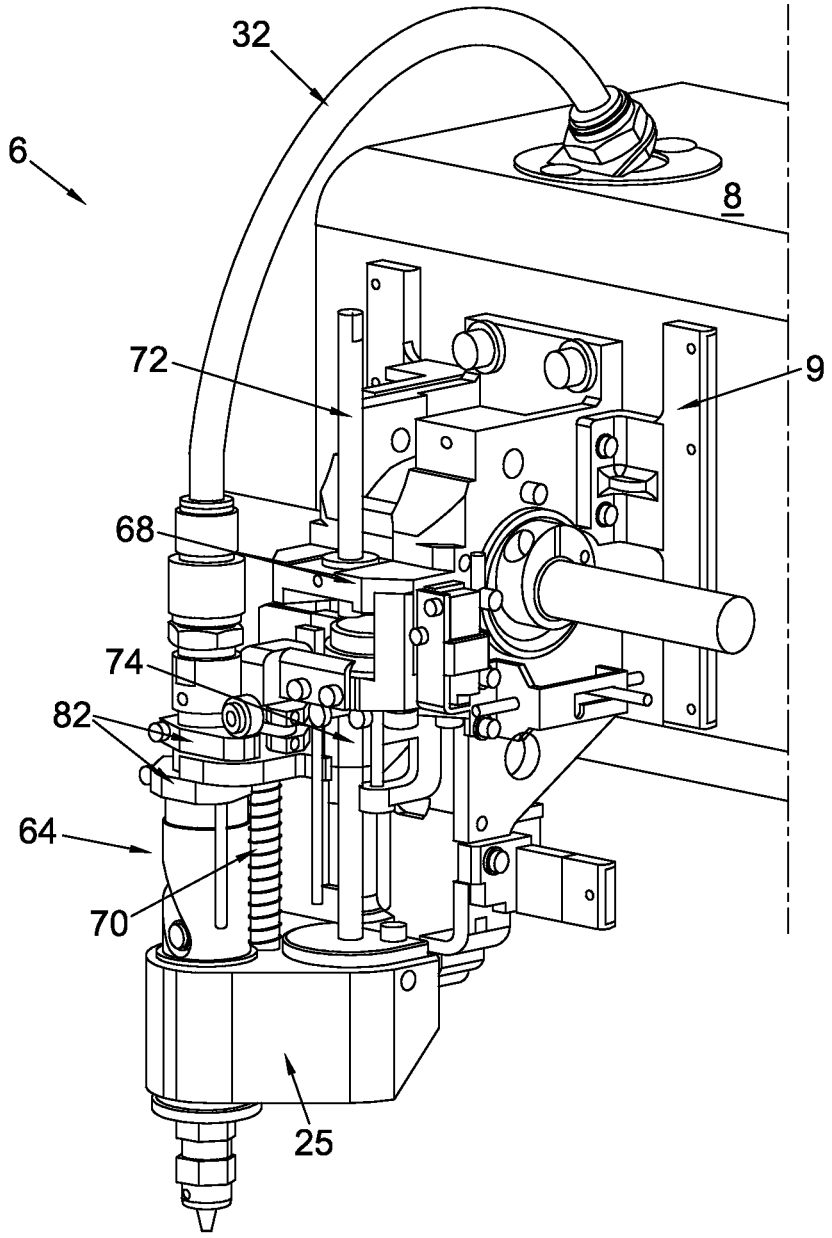
FIG. 4 is a perspective view of the interior of the perforating device of FIG. 3.
Figure 5:
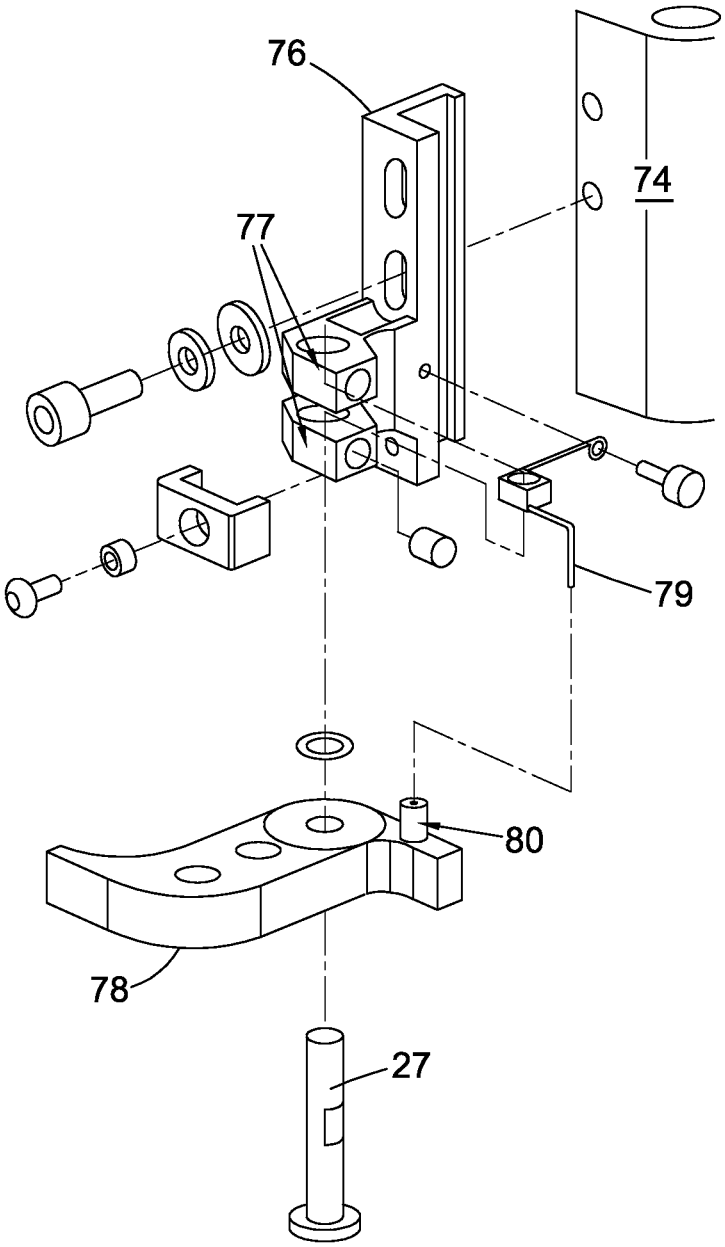
FIG. 5 is an exploded view of part of a driver assembly of the perforating device of FIG. 3.

FIG. 4 shows the interior of the perforating device 6. The suction tube 32 is connected to a perforation or driven assembly, generally designated by 64, by a quick-fix connector or the like, and extends through the beam 8 to a collection bucket 66, as shown in FIG. 1. The perforating device 6 further comprises a base 25, through which part of the perforation assembly 64 extends, and a driver assembly, generally designated by 68, arranged to drive or push the perforation assembly 64 downwards against the biasing force of a compression coil spring 70. The driver assembly 68 comprises a transducer, such as an electromechanical solenoid, for converting electrical energy into linear motion for driving the perforation assembly 64 up to 460 times per minute. The driver assembly 68 further comprises a vertical drive shaft 72, for guiding the linear motion of the driver assembly 68. A bracket 74 forms part of the driver assembly 68 and is arranged for movement along the drive shaft 72 in upwards and downwards directions. With reference to FIG. 5, a driver fixing base 76 is fixedly connected to the upper section of the bracket 74 by at least one socket bolt. Two arms 77 protrude from the lower section of the driver fixing base 76, one arm being positioned directly above the other arm to define a space therebetween. A driver component 78 is held under the lower arm by a driver pin 27 extending through the driver component 78 and the arms 77. A torsion coil spring 79 is positioned around the driver pin in the space defined between the arms 77. One end of the torsion coil spring 79 is fixed to the side of the driver fixing base 76 and the other end is arranged to be held in a cavity defined by a cylindrical section 80 upwardly extending from the upper surface of the driver component 78. The torsion coil spring 79 functions to hold the driver component 78 in position thereby preventing relative rotation of the driver component 78 about the driver pin 27 with respect to the other components of the driver assembly 68. The driver component 78 is held between two driver guides 82 of the perforation assembly 64 to provide a connection therebetween and transfer the linear motion of the driver assembly 68 to the perforation assembly 64.

Figure 6:
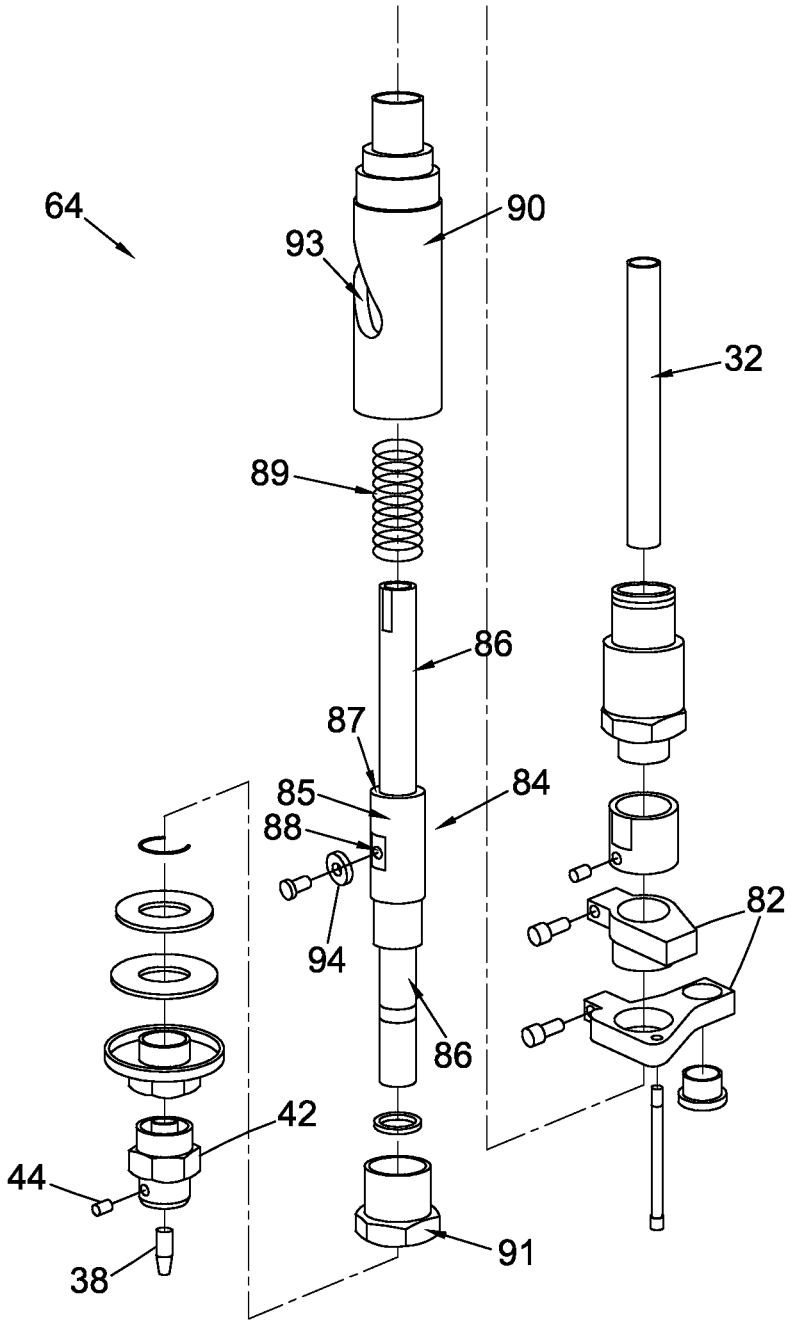
FIG. 6 is an exploded view of a perforation assembly used in the perforating device of FIG. 3.

Turning to FIG. 6, the perforation assembly 64 comprises a hollow cylindrical rotation shaft 84 including a central section 85, and upper and lower end sections generally designated by 86. The central section 85 has a larger diameter when compared to the end sections 86 and includes a screw hole 88. A compression coil spring 89 is positioned around the upper end section 86 and rests on a shoulder 87 created at the junction between the central section 85 and the upper end section 86. The perforation assembly 64 further comprises a sliding shaft 90 that is arranged to slide over the rotation shaft 84 in a concentric arrangement. Preferably, the sliding shaft 90 is made of aluminium in order to reduce the overall weight of the perforation assembly 64 and, in turn, increase the maximum velocity at which the perforation assembly 64 can be moved by the driver assembly 68. A fixing nut 91 is used to hold the sliding shaft 90 about the rotation shaft 84 to establish a small clearance between the outer surface of the central section 85 and the inner surface of the sliding shaft 90, thereby allowing rotation of the rotation shaft 84 relative to the sliding shaft 90 about its longitudinal axis. When the perforation assembly 64 is assembled, the spring 89 is held between a shoulder 87 of the rotation shaft 84, defined between the central section 85 and the upper end section 86, and an opposing surface inside the sliding shaft 90. The sliding shaft 90 comprises an open track 93 defining a path that coils around substantially a third of the shaft's circumference, the lowermost section of which is arranged to line up with the screw hole 88 in the central section 85 of the rotation shaft 84. The screw hole 88 is arranged to receive a shoulder button bolt, or the like, which configured to carry a roller 94. The rotation shaft 84 is configured to move upwards with respect to the sliding shaft 90 against the biasing force of the spring 89 during the operation of the perforation assembly 64. This relative axial movement causes the roller 94 to move along the open track 93 thereby causing a simultaneous rotation of the rotation shaft 84 within the sliding shaft 90. Preferably, the roller 94 is made of a synthetic resin, which is a softer material than metal, ensuring that the roller 94 is less likely to damage the rotation shaft 84 as it moves along the open track 93. This is particularly important when the sliding shaft 90 is itself made of a relatively soft material such as aluminium. The extent to which the rotation shaft 84 can rotate within the sliding shaft 90 is limited by the length of the open track 93. In the embodiment shown, the respective rotation between the shafts 84, 90 is approximately 40 degrees. However, it will be apparent to those skilled in the art that the perforation assembly 64 could be configured such that the respective rotation between the shafts 84, 90 is more or less than 40 degrees.

Figure 7:
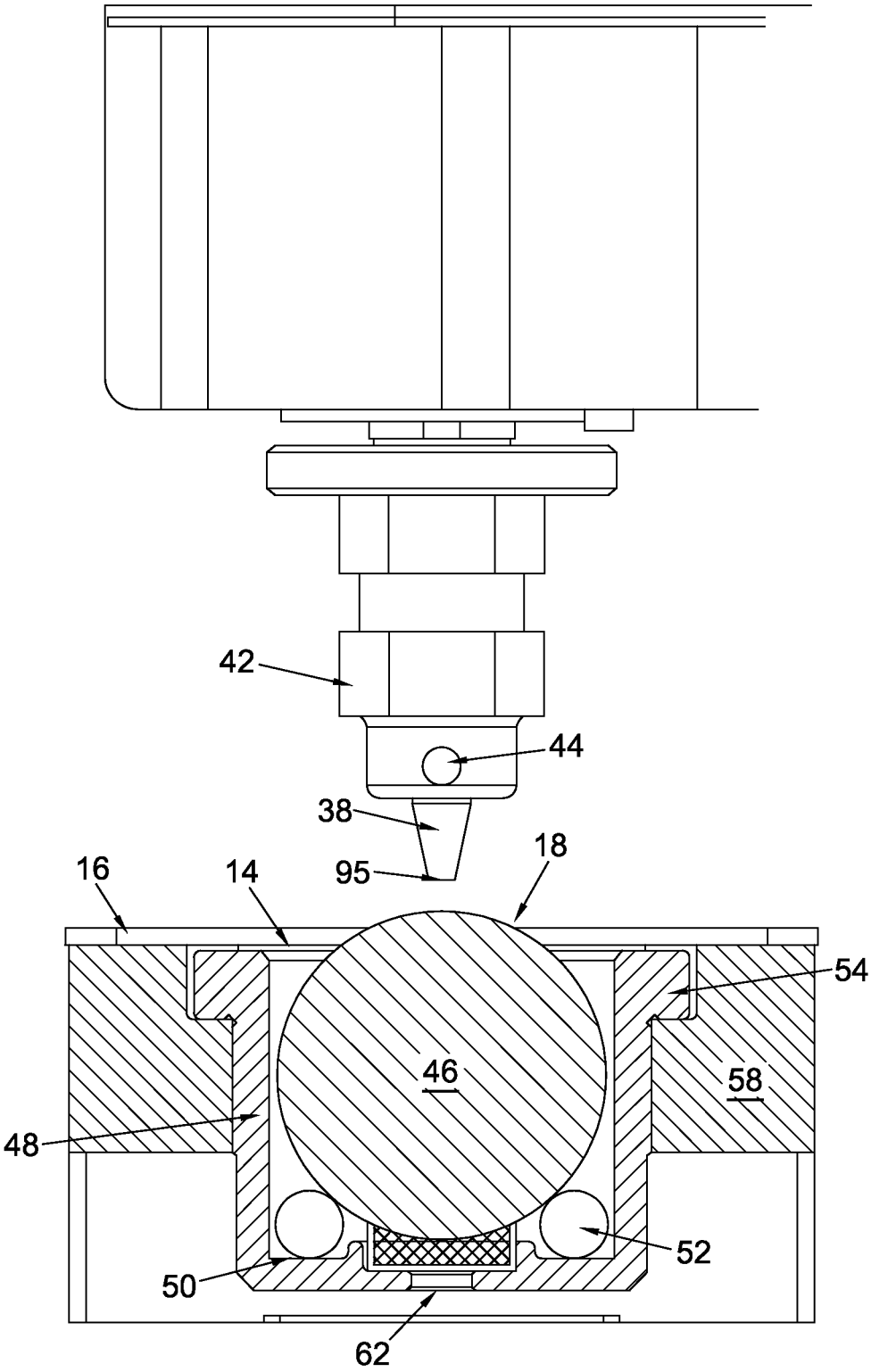
FIG. 7 is a side view of a perforating head of the perforating device of FIG. 3, together with a sectional view of a sacrificial ball and ball housing.

FIG. 7 shows the perforating unit 64 comprising a concentrically mounted hollow perforation knife 38. The knife 38 is removably connected to the lower end of the rotation shaft 84 by a fixing nut 42. The knife 38 comprises a frusto-conical surface tip portion that terminates in a circular cutting edge 95, together with a cylindrical channel 96 extending through the knife 38 from the cutting edge 95 to the end of the knife 38 remote from the cutting edge 95. The cylindrical channel 96 is in fluidic communication with the hollow interior of the rotation shaft 84 when the knife 38 is connected thereto. The knife 38 is inserted into a hole in the bottom of the fixing nut 42 and is secured in position by a frictional connection created by a screw 44 located in the side of the fixing nut 42. This convenient arrangement of securing the knife 38 to the fixing nut 42 avoids the need to remove the housing 30 when replacing the knife 38. A resiliently deformable sacrificial ball 46 protrudes through the opening 18 in the needle plate 16 located directly below the knife 38 and functions as a rotatable spherical surface into which the cutting edge 95 impacts during the operation of the perforation assembly 64. In the embodiment shown, the diameter of the ball 46 is 40 mm. Preferably, the ball 46 is solid and is made of substantially polypropylene with a density between 0.855 and 0.946 g/cm$^3$ and a Young's modulus between 1300 and 1800 N/mm$^2$. This ensures that the ball 46 remains useable for substantially 30,000 impacts of the cutting edge before it needs replacing. When a panel of material is held in the inner frame 24, the part of the ball 46 extending above the upper surface of the needle plate 16 directly contacts the underside of the panel of material to establish a frictional connection therebetween. In the embodiment shown, the upper section of the ball 46 extends approximately 2 mm above the upper surface of the needle plate 16. The ball 46 is held in a cylindrical ball housing 48. The base of the housing 48 comprises a concentric bearing race 50 for guiding a plurality of ball bearings 52 spaced at equal circumferential intervals. The ball bearings 52 are free to rotate on the bearing race 50. Alternatively, the ball bearings 52 may be placed directly on the base of the housing 48. Twelve ball bearings 52 are used in the embodiment shown. The ball 46 is arranged to sit on the plurality of ball bearings 52 thereby establishing direct connection between the ball 46 and each ball bearing 52. The ball bearings 52 function firstly to concentrically align the ball 46 with the main axis of the housing 48 thereby preventing the ball 46 from touching the internal sides of the housing 48. Secondly, the arrangement of the ball bearings 52 allows the ball 46 to rotate within the housing 48 in all directions whilst maintaining its alignment with the main axis of the housing 48. That is, the ball 46 is configured to remain in a fixed point in space while it rotates about that point in any direction. The upper end of the housing 48 includes a flange 54, the bottom surface of which is arranged to meet the upper surface of a flanged section of a perforation bed 58 to hold the housing 48 from the perforation bed 58. The housing 48 is secured to the perforation bed 58 by a plurality of socket bolts. The housing 48 further comprises a concentric access hole 62, which is located directly below the ball 46. A screw driver or the like can be inserted through the access hole 62 to lift the ball 46 from the housing 48, thereby allowing replacement of the ball 46 without first having to remove the housing 48 from the perforation bed 58.

Figure 8:
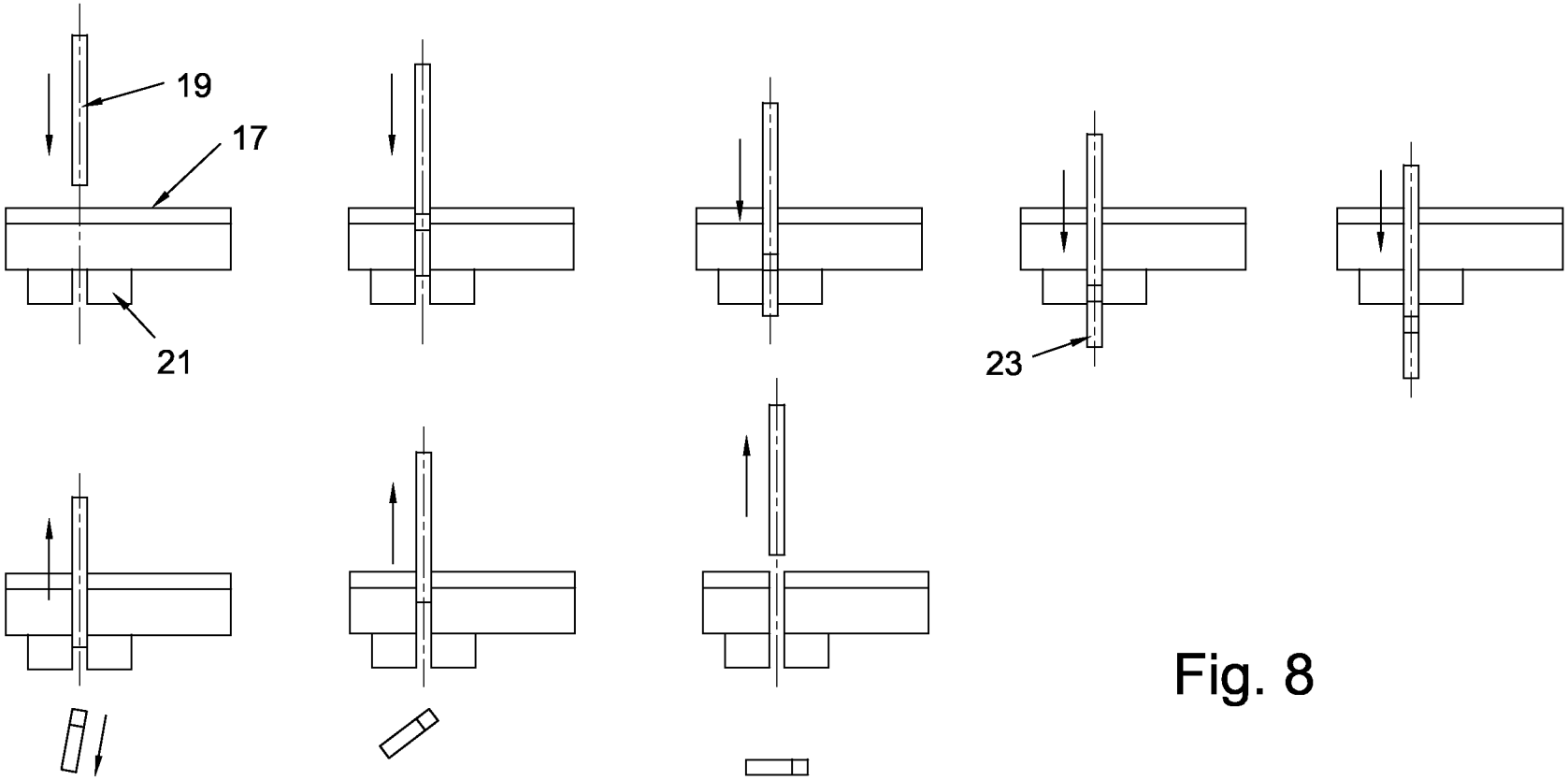
FIG. 8 is a schematic representation of the various stages of perforating a panel of material using a conventional press tool; and, FIG. 9 is a schematic representation of the various stages of perforating a panel of material using the perforating device of FIG. 3.

FIG. 8 is a schematic representation of the various stages of perforating a panel of laminated material 17 using a conventional press tool comprising a male punch 19 and a female die 21. In this instance, the panel of material 17 will already have been quilted. The panel of material 17 is held between the male punch 19 and the female die 21, and the male punch 19 is moved downwards towards the female die 21 along a substantially linear path. The shearing force created in the panel of material 17 by the movement of the male punch 19 relative to the female die 21 causes a slug 23 of material to be torn from the panel of material 17 and the continued movement of the male punch 19 pushes the slug 23 through the female die 21. A suction may be applied downstream of the female die 21 to assist with the removal of the slug 23 to a collection bucket held underneath the press tool. As multiple slugs 23 are being punched at once, the collection bucket tends to be an open vessel. This can result in dust or the like escaping from the collection bucket. The male punch 19 is then moved upwards leaving a hole in the panel of material 17.

Figure 9:
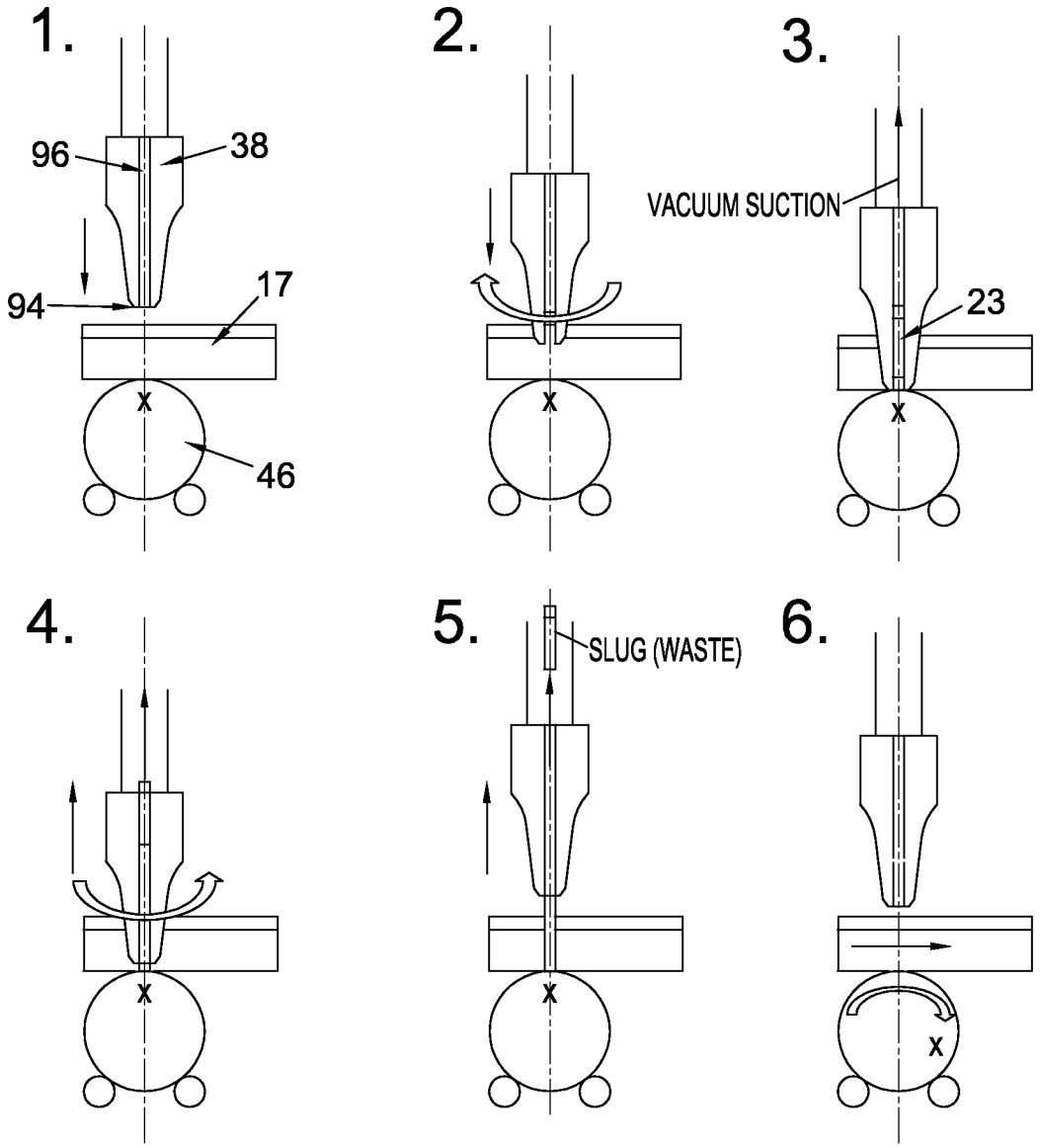

FIG. 9 is a schematic representation of the steps of perforating a panel of material 17 using the perforating device 6 of the present invention. Six general steps are shown. In step 1, starting from an initial position or uppermost position, the perforation assembly 64 is moved downwards along its longitudinal axis by the driver assembly 68 towards the panel of material 17 held by the inner frame 24 between the cutting edge 95 of the knife 38 and the sacrificial ball 46.

An upwards force is applied to the cutting edge 95 as the cutting edge 95 contacts the panel of material 17, as shown in step 2. This upwards force impedes the downwards movement, or feed motion, of the rotation shaft 84 when compared to the downwards movement of the sliding shaft 90 causing relatively movement therebetween, which acts against the biasing force of the spring 70. That is, the upwards force acting on the cutting edge 95 causes the rotation shaft 84 to move upwards relative to the sliding shaft 90. This relative movement in turn causes the roller 94 to move upwards along the upper surface of the open track 93 resulting in a simultaneous rotation of the rotation shaft 84 within the sliding shaft 90 as the perforating unit 64 continues to move downwards. The combined feed motion and rotational movement produces a cutting force at the cutting edge 95 that cuts into the panel of material 17 as opposed to the shearing action used by a conventional press tool. In the embodiment shown the rotation shaft 84 rotates in a clockwise direction during the feed motion. However, it will be apparent to those skilled in the art that the perforation assembly 64 could be configured such that the rotation shaft 84 rotates in an anticlockwise direction during the feed motion.

The simultaneous downward and rotational movement of the knife 38, caused by the relative linear movement between the rotation shaft 84 and the sliding shaft 90 against the biasing force of the spring 70, continues until the downward movement of the driver assembly 68 is completed, which marks the end of the feed motion and defines the lowermost position of the cutting edge 95. The end of the feed motion is arranged substantially to coincide with the point at which the cutting edge 95 impacts the resiliently deformable ball 46 as shown in step 3. The rotation of the rotation shaft 84 during the feed motion is also complete at this point since the roller 94 as reached the end of the open track 93 preventing any further upward movement of the rotation shaft 84 relative to the sliding shaft 90. At the end of the feed motion a slug 23 has been cut out of the panel of material 17 and is held in the interior of the knife 38.

Step 4 shows the start of the upward movement, or return motion, of the perforation assembly 64. At this stage, the spring 70, arranged to resist downward movement of the driver assembly 68, is compressed. Similarly, the spring 89 held between the shoulder 87 of the rotation shaft 84 and an opposing surface inside the sliding shaft 90 is also compressed. The force produced from the impact of the cutting edge 95 on the ball 46 is transferred from the rotation shaft 84 to the sliding shaft 90 by the spring 89 causing the sliding shaft 90 to move upwards together with the driver assembly 68. The upwards movement of the sliding shaft 90 and the driver assembly 68 is assisted by the spring 70, which urges the driver assembly 68 away from the base 25 of the perforation device 6. The force produced by the spring 89 of the perforation assembly 64, which functions to urge the rotation and sliding shafts 84, 90 apart, is sufficient to overcome frictional forces between the shafts 84, 90 so that the upwards movement of the sliding shaft 90 is not transferred to the rotation shaft 84 during the initial stage of the return motion. That is, the rotation shaft 84 is prevented from moving upwards during the initial stage of the return motion by the spring 89 whereas the sliding shaft 90 is configured to move upwards, relative to the rotation shaft 84. Upward movement of the sliding shaft 90 relative to the rotation shaft 84 causes the roller 94 to move downwards along the lower surface of the open track 93. This movement, in turn, causes the rotation shaft 84 to rotate in an anticlockwise direction.

The rotation of the rotation shaft 84 during the return motion is completed once to roller 94 reaches the lower end of the open track 93. Continued upward movement of the sliding shaft 90 from this point lifts the knife 38 out of the bore created in the panel of material 17 and the shafts 84, 90 move together back to the initial position preceding step 1, as shown in step 5.

Turning to step 6, once the perforation assembly 64 has returned to the initial position, the panel of material 17 can be moved by the pantograph 20 in the horizontal plane relative to the perforation assembly 64 so that a second slug 23 may be cut from the panel of material 17. The frictional engagement between the panel of material 17 and the ball 46 causes the ball 46 to rotate on the ball bearings 52 as the panel of material 46 is moved in the horizontal plane. This movement changes the point at which the cutting edge 95 impacts the ball 46 during the feed motion, as indicated by the "x" in step 6 changing position when compared to the previous steps.

A low pressure or vacuum is applied to the channel in the knife 38 by a motor or the like positioned downstream of the collection bucket 66 throughout these steps. This causes any slugs 23 in the interior of the knife 38 to be sucked up through the channel in the knife 38, the rotation shaft 84 and the suction tube 32, and into the collection bucket 66. This enables the collection of slugs 23 in a closed environment, which prevents dust and the like from being released. The fact that the cutting edge 95 cuts into the panel of material means that the longitudinal sides of the slugs 23 are less frayed when compared to slugs 23 produced by the shearing action of conventional press tools, which tends to tear or rip the material. This makes it easier to suck the slugs 23 into the collection bucket 66.

The above specific embodiment has been described by way of example only, and should therefore be considered as illustrative and not restrictive. It will be appreciated that variations of the described embodiment may be made without departing from the protective scope of the invention as defined by the claims.

The invention claimed is:

1. An apparatus for perforating a panel of material comprising a driver assembly;

a perforation assembly comprising a cutting edge for perforating the panel of material;

a ball arranged so as to be rotatable about a fixed point, said ball comprising a spherical impacting surface; and, a means for holding the panel of material in a material plane between the cutting edge and the ball, wherein the driver assembly is arranged to drive the cutting edge in a linear motion transverse to and through the material plane into the spherical impacting surface to perforate the panel of material, the cutting edge remains equidistant to an axis of the linear motion during the perforation, and the apparatus is arranged such that the ball is rotatable in any direction with respect to the cutting edge so that the cutting edge will be driven into different points anywhere on the spherical impacting surface during use.

2. The apparatus according to claim 1, wherein the ball is held in a housing and is arranged to sit on a plurality of ball bearings located at the bottom of the housing.

3. The apparatus according to claim 1, further comprising a positioning means for moving the panel of material in the material plane with respect to the cutting edge.

4. The apparatus according to claim 3, wherein the material plane is positioned so that the underside of the panel of material held by the holding means contacts the spherical impacting surface of the ball providing a frictional connection therebetween, whereby the ball is rotatable as the panel of material is moved in the material plane by the positioning means.

5. The apparatus according to claim 1, wherein the spherical impacting surface is resiliently deformable.

6. The apparatus according to claim 1, wherein the driver assembly is arranged to drive the cutting edge into the spherical impacting surface against a biasing means.

7. A quilting and perforating machine comprising the apparatus according to claim 1.

8. The apparatus of claim 1, wherein the driver assembly includes a shaft;

the cutting edge of the perforation assembly is mounted on an end of the shaft; and the driver assembly is arranged to drive the cutting edge in the linear motion along a longitudinal axis of the shaft.

9. The apparatus of claim 8, wherein the perforation assembly is further configured to rotate the shaft and the cutting edge about the longitudinal axis when the cutting edge is driven in the linear motion.

10. The apparatus of claim 1, wherein the means for holding the panel of material moves the panel of material in the material plane with frictional contact between the panel of material and the ball to thereby rotate the ball.

11. A method for perforating a panel of material comprising the steps of holding the panel of material in a material plane between a cutting edge for perforating the panel of material and a ball arranged so as to be rotatable in any direction about a fixed point, said ball comprising a spherical impacting surface;

driving the cutting edge in a linear motion transverse to and through the material plane into the spherical impacting surface to perforate the panel of material, wherein the cutting edge stays equidistant from an axis of the linear motion during the perforation; and, rotating the ball and thus the spherical impacting surface with respect to the cutting edge so that the cutting edge will be driven into different points anywhere on the spherical impacting surface during use.

12. The method according to claim 11, further comprising the steps of positioning the material plane so that the underside of the panel of material contacts the spherical impacting surface to provide a frictional connection therebetween and moving the panel of material in the material plane to move the spherical impacting surface.

13. The method of claim 11 further comprising rotating the cutting edge about the axis of the linear motion while driving the cutting edge through the material plane.

* * * * *